US006698323B2

(12) United States Patent
Formon et al.

(10) Patent No.: US 6,698,323 B2
(45) **Date of Patent: *Mar. 2, 2004**

(54) APPARATUS AND METHOD FOR DETECTING WHEN A WEB IS NOT BEING PERFORATED

(75) Inventors: John S. Formon, Orange Park, FL (US); Bernie Dodge, Satsuma, FL (US); Andrew Morris, Green Cove Springs, FL (US)

(73) Assignee: Georgia-Pacific Corporation, Atlanta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/567,267

(22) Filed: May 9, 2000

(65) Prior Publication Data

US 2003/0172785 A1 Sep. 18, 2003

(51) Int. Cl.[7] ..... B26D 7/24
(52) U.S. Cl. ..... 83/62; 83/62.1; 83/522.27
(58) Field of Search ..... 83/62, 62.1, 74, 83/522.27, 522.25, 942; 324/522, 523, 525, 527, 510; 234/30–34; 192/129 A

(56) References Cited

U.S. PATENT DOCUMENTS

| | | | | | |
|---|---|---|---|---|---|
| 1,717,426 | A | | 6/1929 | Weaver | |
| 2,792,883 | A | | 5/1957 | Pokorski | |
| 2,870,840 | A | | 1/1959 | Kwitek | |
| 3,124,026 | A | * | 3/1964 | Loeffel | 83/62 |
| 3,339,434 | A | | 9/1967 | Sparling | |
| 3,381,559 | A | | 5/1968 | Lefever et al. | |
| 3,585,886 | A | * | 6/1971 | McDonald | 83/62 |
| 3,747,142 | A | * | 7/1973 | Arbogast et al. | 83/62 |
| 3,769,666 | A | * | 11/1973 | Kaufman | 324/61 R |
| 3,771,399 | A | | 11/1973 | Aterianus | |
| 4,055,101 | A | | 10/1977 | Collins | |
| 4,074,599 | A | | 2/1978 | Allen | |

(List continued on next page.)

*Primary Examiner*—Allan N. Shoap
*Assistant Examiner*—Omar Flores-Sänchez
(74) *Attorney, Agent, or Firm*—Banner & Witcoff, Ltd.

(57) ABSTRACT

The present invention provides a web perforating apparatus which includes a system for detecting and indicating when a blade in the apparatus is broken, dull or otherwise not perforating the web. The apparatus is typically used with rewinders or other similar machines that produce perforated sheets of products, such as paper, using sets of stationary anvil blades and rotating perforating blades. The apparatus comprises at least one anvil including a blade holder and an anvil blade which is positioned within the blade holder. The blade holder is formed of an insulating material for electrically isolating the anvil blade from the machine frame of the rewinder. An electrical conductor is coupled to the anvil blade for supplying an electric current to the anvil blade from a current source. The apparatus also includes at least one grounded perforating blade for moving relative to the anvil blade and cooperating with the anvil blade to perforate the web at predetermined points along its length. The perforating blade will contact the anvil blade after perforating the web. A closed circuit is formed and maintained along the anvil blade at points where the blades are in contact with each other. The apparatus further includes means for detecting if a closed circuit has been formed and maintained along the anvil blade when the perforating blade moves into a position where the blades should contact each other.

22 Claims, 7 Drawing Sheets

U.S. PATENT DOCUMENTS 4,120,196 A * 10/1978 Hamilton et al. ..... 73/104
4,205,567 A * 6/1980 Hirata et al. ..... 83/62
4,251,872 A * 2/1981 Bone ..... 364/551
4,355,554 A 10/1982 Gregory, III
4,744,241 A * 5/1988 Mayer ..... 73/104
4,813,320 A 3/1989 Malloy et al.
5,091,962 A 2/1992 Malloy et al.
5,117,718 A 6/1992 Wittkopf
5,584,216 A * 12/1996 Sinjen ..... 83/62.1
5,765,458 A * 6/1998 Nakagawa et al. ..... 83/13

* cited by examiner

APPARATUS AND METHOD FOR DETECTING WHEN A WEB IS NOT BEING PERFORATED

BACKGROUND OF THE INVENTION

1. Field of the Invention

The invention relates to a system for detecting when a web is not being completely perforated, cut, scored or otherwise weakened at spaced intervals along its length, and more particularly to a web perforating system that detects and indicates when a perforator in a rewinder or similar machine is operating with a broken or dull perforating blade.

2. Description of the Prior Art

During the production of paper products such as toilet tissue and paper towel rolls, a paper web is unwound from a parent roll by a rewinder as is well known in the art. As the paper web enters the rewinder, it contacts one or more rolls which deliver it to a web cutting apparatus or "perforator" that is equipped with a perforating roll. One such perforator is disclosed in U.S. Pat. No. 2,870,840 to Kwitek which is hereby expressly and completely incorporated by reference. The perforator includes a perforating roll carrying rows of perforating blades or "fly knives." These rows are spaced from each other along the circumference of the perforating roll. The perforating blades rotate relative to and cooperate with stationary anvils that carry anvil blades. The anvils are secured in a helical pattern to a perf anvil head which extends across the path of travel of the web. The perf anvil head in such a device can rotate relative to the perforating roll between an open position and an operating position. In an open position, the perf anvil head spaces the anvils from the perforating blades so that the web will not be perforated. When the perf anvil head is rotated into the operating position, the perforating blades contact the anvil blades and perforate the passing web, thereby creating perforations at predetermined spaced intervals in the passing web. After the web passes through the perforator, it moves to a winding system which winds it onto a core.

A perforating roll can rotate at speeds typically up to 1500 feet per minute. As a result, the perforating blades experience high compressive and shearing forces when they contact the stationary anvil blades. These forces can cause a perforating blade to fail at any time during a production run. Additionally, over time, the teeth of a perforating blade can dull as a result of repeatedly impacting an anvil blade. When the perforator operates with a broken or dull blade, it may not fully perforate the web. As a result, rolls of paper products which are not fully perforated will be sent to the customer. Paper rolls with incomplete perforations are the largest complaint of perforated product customers.

Perforating machines such as that discussed above lack a system for detecting if a perforating blade has broken or become so dull that it does not perforate the passing web. Instead, perforated paper producers rely on an operator to visually inspect the perforations between sheets of a wound paper product at regularly spaced time intervals, such as every hour. Between these inspections, a broken blade may only be detected if the operator hears a noise which suggests that a blade has broken. As difficult as it is for an operator to hear when the perforator is operating with a broken blade, it is virtually impossible to detect if it is operating with a dull blade without visually inspecting the perforated rolls.

If a perforating blade breaks or becomes too dull to properly perforate the web at any time between visual inspections, the machine will continue to operate and produce incomplete perforated products until at least the next visual inspection. For example, if the operator stops and examines the results of the perforating process every hour, a blade that breaks fifteen minutes into a run will cause the perforator to produce forty-five minutes worth of improperly perforated sheet product. This can add up to a significant amount of improperly perforated product when the rewinder is operating at 1500 or more feet of paper web per minute. Additional problems associated with visual inspection are the loss of production time if the line is shut down while the visual inspection is performed, and the waste of the product that is used for the inspection.

Various machines have included systems to detect when a web has not been properly prepared. One such system is disclosed in U.S. Pat. Nos. 4,813,320 and 5,091,962 to Malloy et al. which disclose a stamping machine having an associated sensing device for determining when a stamped web has been incorrectly fed. After the web is stamped, it passes from the press to a sensing device which includes an internal coil for generating an electromagnetic flux field. The sensing device produces a waveform which is based upon the amount of metal in the web and the position of the stamped portions relative to the sensors. This waveform is compared to a reference waveform. If a deviation exists between the waveforms, this indicates that the web was incorrectly fed. The stamping machine is then stopped and the position of the web is corrected. However, since the sensing device is spaced away from the press, the press will continue to stamp the incorrectly fed web and create waste for the length of time that it takes the frame with the first perceptible amount of deviation to reach the sensor.

U.S. Pat. No. 3,339,434 to Sparling discloses a drill press including a monitoring apparatus that generates a control signal when the drill bit is broken or dull. The monitoring apparatus measures the duration of each drilling cycle and compares it with a reference cycle. Extended cycle times are caused by broken or dull drill bits taking longer to contact a reference point, such as the work piece, than a normally operating drill bit. When the measured cycle exceeds the reference cycle, a control signal is generated, indicating that a problem exists with the process. An apparatus which uses a timing cycle for monitoring a plurality of drill bits is also disclosed.

U.S. Pat. No. 2,792,833 to Pokorski discloses an automated cutting press that forces a cutting die through a sheet material until it contacts a cutting block. The reciprocating die and cutting block include electrically conductive surfaces. A detection system establishes a circuit when the die and cutting block contact each other. The circuit affects the retraction of the die to its starting position so that the cycle can be repeated. This system is designed to automate the operation of the press, not to detect the presence of a broken tool. Additionally, this system will operate with a broken tool, as long as the tool can be forced through the sheet material and at some time contact the cutting block. This can result in a substrate cut that is not properly sized or shaped.

It is an object of the present invention to overcome the drawbacks associated with the prior art rewinders and perforators.

It is also an object of the present invention to provide a perforator that detects and indicates when one of its blades breaks or becomes so dull that it cannot properly perforate a web.

A further object of the invention is to provide a method for detecting when a perforator is operating with a broken or dull perforating blade.

SUMMARY OF THE INVENTION

The present invention provides a web perforating apparatus which includes a system for detecting and indicating when a blade in the apparatus is broken, dull or otherwise not making contact with an opposing blade and thereby not perforating the web. This apparatus is typically used with rewinders or other similar machines that produce perforated sheets of products, such as paper, using sets of stationary anvil blades and rotating perforating blades. The perforating blades are typically attached to a bed roll and rotate relative to the anvil blades. These anvil and perforating blades are finely adjusted to make light, accurate contact with each other. As the perforating blades contact the web extending across the anvil blades, perforated product is produced. The anvil blades are solid in profile shape and connected to a movable mounting bar by blade holders. The blade holders secured to the rewinder also hold electric conductors for supplying a low amperage current to the anvil blades. The anvil blades and conductors are insulated from the grounded blade holders and the remainder of the machine base so the applied current does not go to ground.

The electric current is used to detect when the perforating blade is not extending through the web and contacting the anvil blade. As the grounded perforating blades make contact with the current carrying anvil blades, a closed circuit is formed, a signal is generated and a representation, such as a waveform is produced. When all the perforating blades properly contact the anvil blades, a "normal" waveform is produced and recorded. If a perforating blade is broken, the recorded waveform will include an anomaly. The presence of the anomaly can be transmitted to the machine operator via a flashing light, siren etc. When an anomaly is detected, the machine can be quickly, if not immediately or automatically, shut down and the broken blade changed so as to reduce the amount of unperforated product. This detection system prevents a broken blade from unknowingly being used during the production of perforated paper product.

In an embodiment of the present invention, the apparatus comprises at least one anvil including a blade holder and an anvil blade which is positioned within the blade holder. The blade holder is formed of an insulating material for electrically isolating the anvil blade from the machine frame of the rewinder. An electrical conductor is coupled to the anvil blade for supplying an electric current to the anvil blade from a current source. The apparatus also includes at least one grounded perforating blade for moving relative to the at least one anvil blade and cooperating with the at least one anvil blade to perforate the web at predetermined points along its length. The at least one perforating blade will contact the anvil blade after perforating the web. A closed circuit is formed and maintained along the at least one anvil blade as long as the perforating blade remains in contact with the anvil blade. Since the anvil blades are on a spiral mount, their contact with the perforation blades is progressive. This results in progressive single point contact between the perporation and anvil blades along the length of the anvil blades. The apparatus further includes means for detecting if a closed circuit has been formed and maintained along the anvil blade when the perforating blade moves into a position where it should make contact with the anvil blade.

The present invention also includes a method for perforating a web using a perforating apparatus and detecting when the web is not being completely perforated. The method comprises the steps of grounding a first blade of the perforating apparatus, electrically isolating a second blade of the perforating apparatus from a ground and connecting the isolated second blade to an electric current source. The method also includes moving one of the blades relative to the other blade so at least a portion of the first blade contacts a portion of the second blade, and creating a closed circuit at points along the second blade where contact is made between the second blade and the first blade. A step of generating a signal which represents where closed circuits were created along the second blade also forms part of the present invention. Additionally, the method can include the steps of comparing the generated signal to a reference signal, and indicating to an attendant when the generated signal differs from the reference signal.

According to the present invention, an operator will be notified and the perforation run stopped as soon as a broken or dull blade is detected, thereby keeping the amount of unperforated product to a minimum. This will significantly reduce waste and down time by doing away with the need to shut down the run to visually inspect the blades and the need to unroll the produced product to visually inspect the perforations or lack thereof. Moreover, rolls of completely perforated paper can be critical to the operation of dispensers which use the perforation rows to recognize the leading edge of a sheet in order to either begin or stop the paper dispensing process. Proper perforation rows also facilitate clean and complete separation of the sheet when pulled by user.

DETAILED DESCRIPTION OF THE INVENTION

Figure 1:
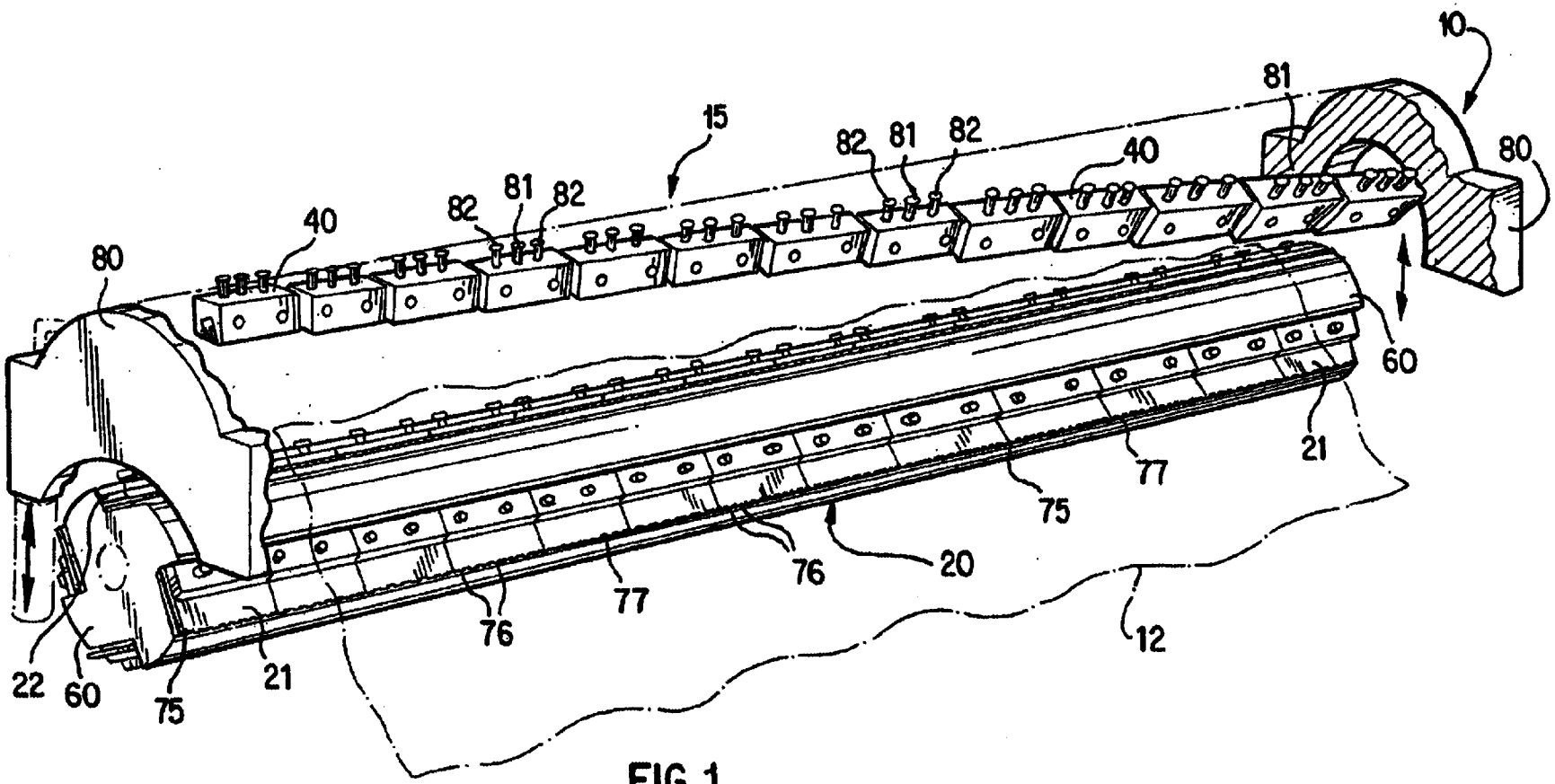
FIG. 1 is a perspective view showing the web perforating apparatus according to the present invention with a perf anvil head partially illustrated.
Figure 2:
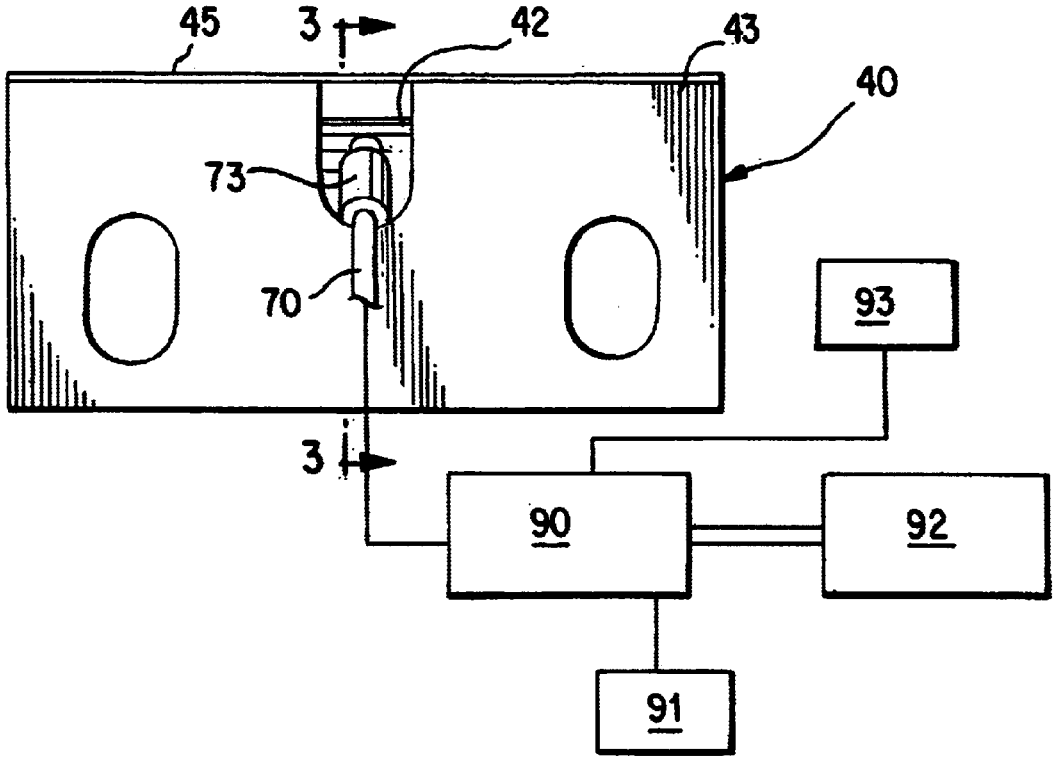
FIG. 2 is a diagrammatic view of a perforation detecting and indicating system according to the present invention.

FIG. 1 illustrates an apparatus 10 including a perforator 15 which is used with a rewinder or similar converting machine for forming lines of perforations, scoring or otherwise weakening a web 12. The lines of perforations are formed at regular or differing intervals along the length of the web 12 and extend across the web 12 in a direction normal to its length. The web 12 can be of any material that is capable of being perforated, especially, materials such as paper or a plastic film that can be wound onto a core with each successive piece being able to be torn off for use. The apparatus 10 can be used with webs having one or more plies.

Figure 6:
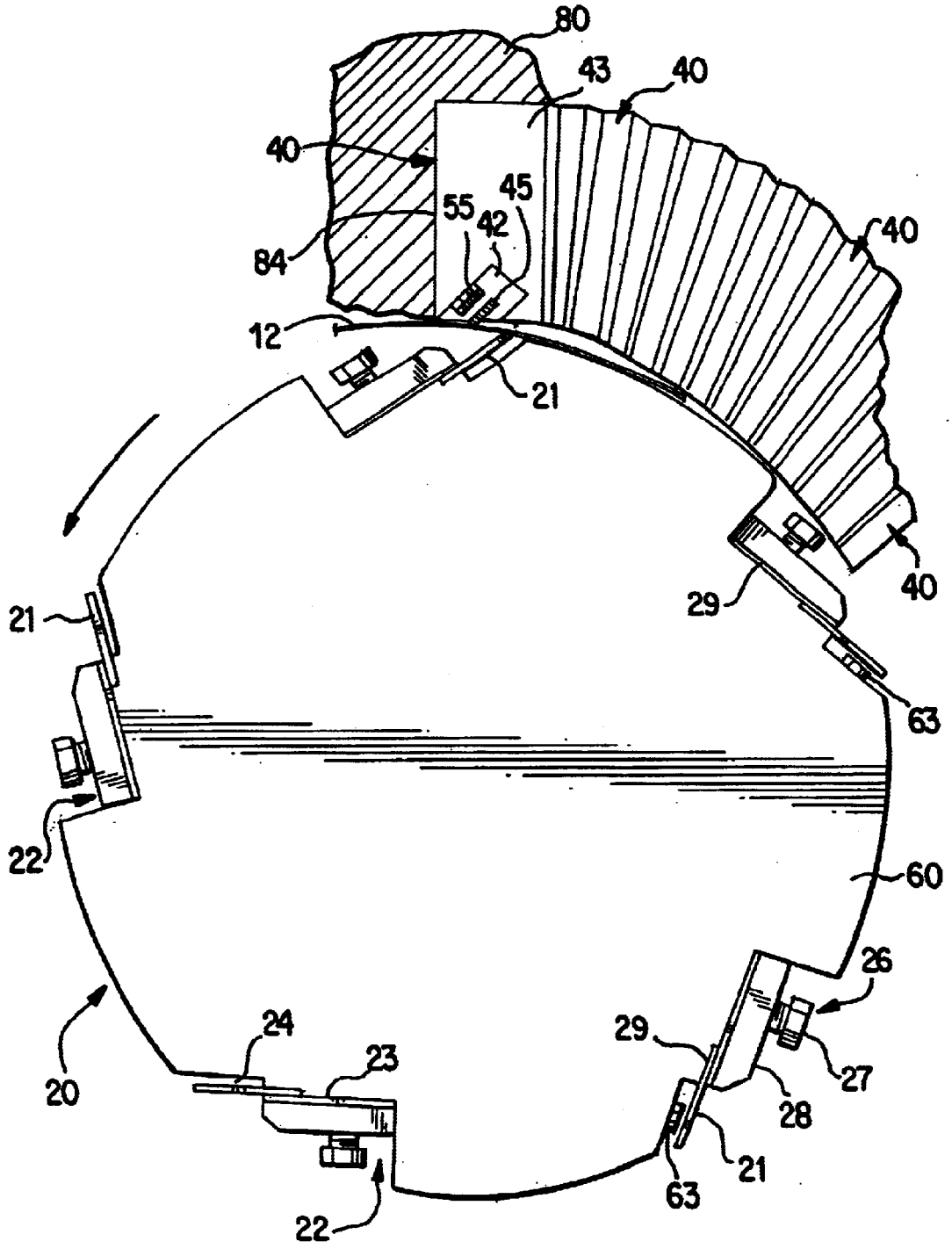
FIG. 6 is a sectional view looking down a perforating shaft showing an anvil blade and a perforating blade in a perforating or cutting step.

The apparatus 10 is typically employed with a rewinder or related machinery. As well known in the art, the web 12 passes over a series of rollers which deliver it from the parent roll to the perforator 15 that is equipped with a perforating roll 20 that cooperates with a plurality of anvils 40 to perforate the web 12. The perforating roll 20 includes an elongated tubular body 60 that can be from 70 to 100 inches long and have a substantially circular cross section, as illustrated in FIG. 6. However, other sized perforations rolls can also be used. The ends of the perforating roll 20 are positioned within bearings and secured to a gear that is driven by a series of gears connected to the output of a drive motor, as is known in the art. The bearings are also secured to the housing of the rewinder to prevent the perforating roll 20 from translating along the rewinder. Alternative known ways of driving the perforating roll 20 are also contemplated. The perforating roll 20 can operate at speeds of up to and exceeding 1000 revolutions per minute.

Figure 4:
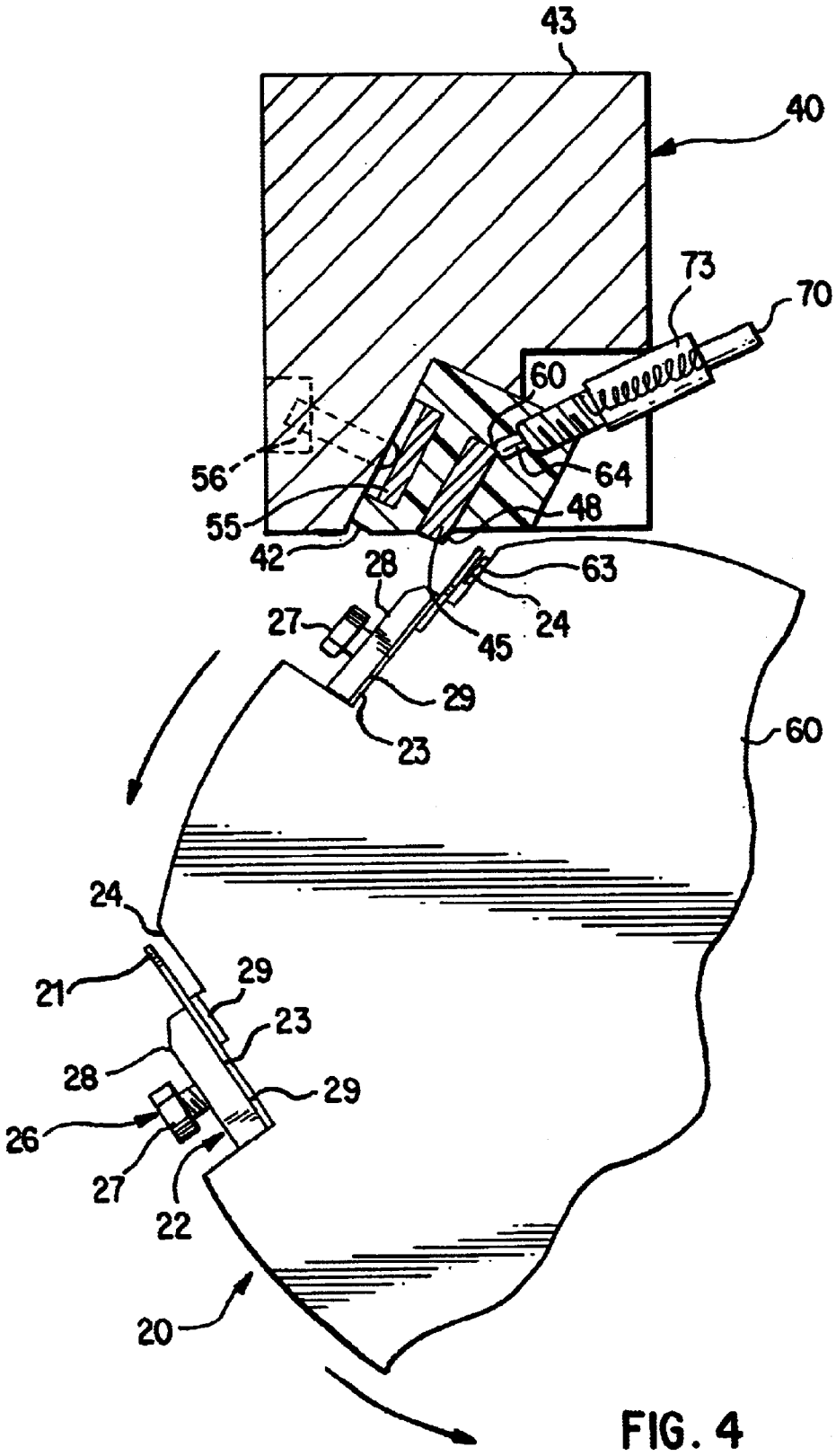
FIG. 4 is a cross section of the perforating apparatus with a perforating roll shown in partial cross section and an anvil shown in cross section.

As shown in FIG. 1, the perforating roll 20 includes transverse rows of perforating blades 21 which are each received in a transversely extending blade holding recess 22. The recesses 22 extend along the length of the perforating roll in a direction substantially parallel to the longitudinal axis of the bed roll 20. Each blade receiving recess 22 has a bearing surface 23 and a notch 24 underlying the installed perforating blade 21, as shown in FIG. 4. The notch 24 relieves the forward edge of the perforating blade 21 during flexing. The transversely extending recesses 20 are spaced from each other around the circumference of the perforating roll 20 by a distance which corresponds to the desired interval between the lines of perforations in the web 12. The shorter the interval between perforations, the more recesses 22 and rows of perforating blades 21 on the perforating roll 20. In a preferred embodiment, the perforating roll 20 includes four longitudinally extending rows of perforating blades 21. However, between three and six rows can also be spaced around the perforating roll 20.

A blade clamp 26 secures each perforating blade to the perforating roll 20 within its respective recess 22. Each blade clamp 26 includes a clamping shoe 28 and an interference bolt 27 which is threaded into a tapped hole in the perforating roll 20. A piece of resilient material 29, such as rubber, can be positioned between the blade 21 and the perforating roll 60. In a preferred embodiment, the perforating blades 21 are secured to the perforating roll 20 so that their forward ends extend a small distance away, such as 0.060 inches from the periphery of the perforating roll 20.

Each perforating blade 21 is typically between four and six inches long. The number of perforating blades 21 within a recess 22 depends on the width of the web being perforated. The wider the web 12, the more perforating blades 21 that must be secured within the recesses 22 of the perforating roll 20. The perforating blades 21 are formed of a resilient steel which flexes when making contact with the anvils 40 during the operation of the perforator. In a preferred embodiment, each perforating blade 21 has a thickness of approximately 0.032 inches which allows it to deflect slightly when it contacts an anvil 40, as discussed below. However, any well known perforating blade could be used with the present invention. Each perforating blade 21 includes a cutting edge 75 having a length aligned with the length of the perforating roll. The cutting edge includes a plurality of cutting contact members 76 that are separated by recesses 77 to create an interrupted cutting surface. This interrupted surface creates the perforated cut extending across the width of the web 12.

As shown in FIG. 1, the perforator includes a pivotable perf anvil head 80 carrying the anvils 40. The anvils 40 extend in a substantially helical pattern across the perf head 80 in a direction which is transverse to the path of travel of the web, as seen in FIG. 1. Each anvil 40 is securely fastened to the perf head 80 to prevent their relative movement during the operation of the perforator. One side of the perf head 80 is rotatably secured to a shaft (not shown) that is connected to the housing of the rewinder or similar machine. The other side of the perf head 80 is connected to a lifting mechanism (not shown) such as a pneumatic cylinder for moving the perf head 80 up to an "open" position and down to an "operating" position. When the lifting mechanism is activated and the perf head 80 is in an operating position, the anvils 40 are positioned to contact their respective perforating blades 21 and perforate the web 12. When the perf head 80 is in an open position, the anvils 40 are spaced away from the perforating blades 21 so that perforation of the web 12 does not occur and the web 12 passes cleanly over the perforating blades 21.

Figure 5:
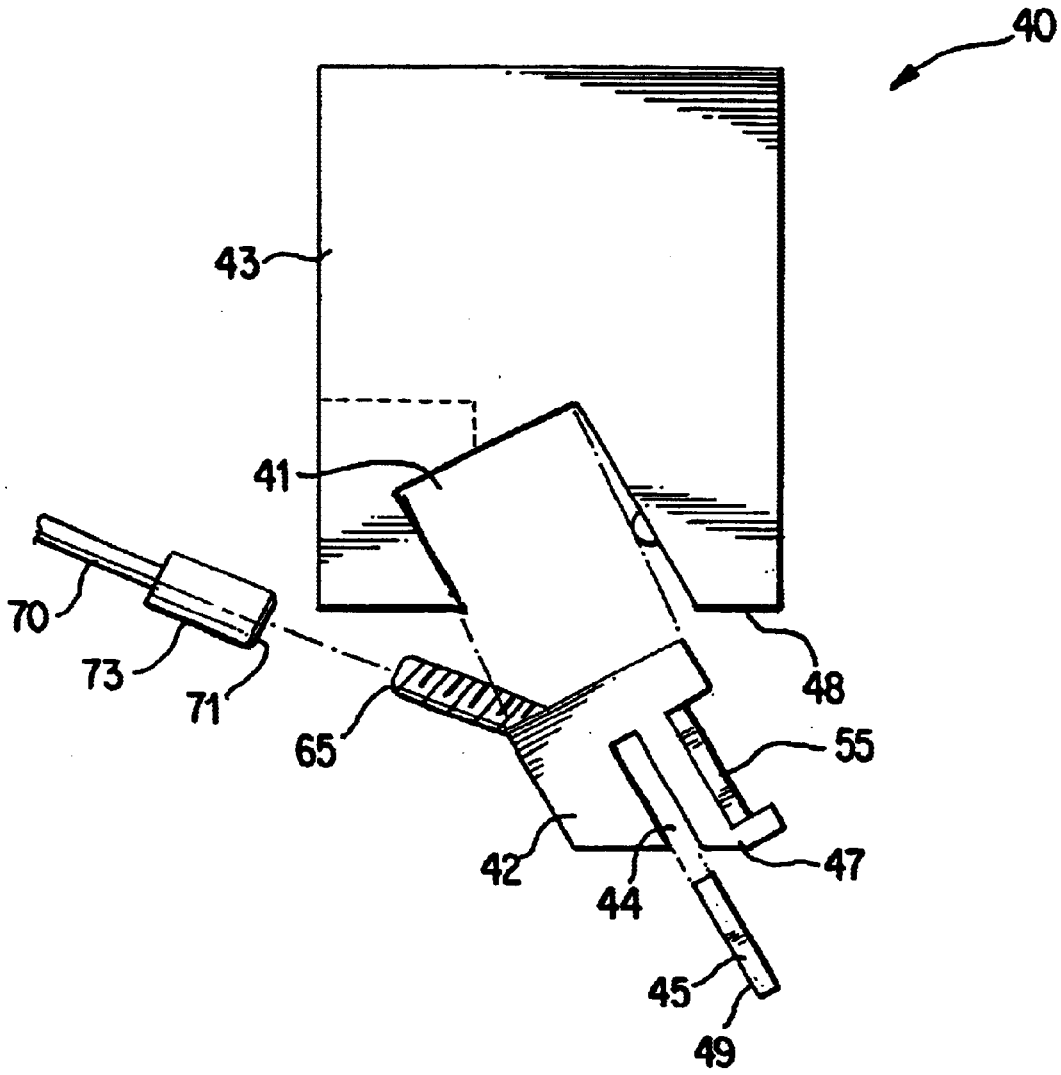
FIG. 5 is an exploded end view of an anvil shown in FIG. 1 and electric current delivering members.
Figure 7:
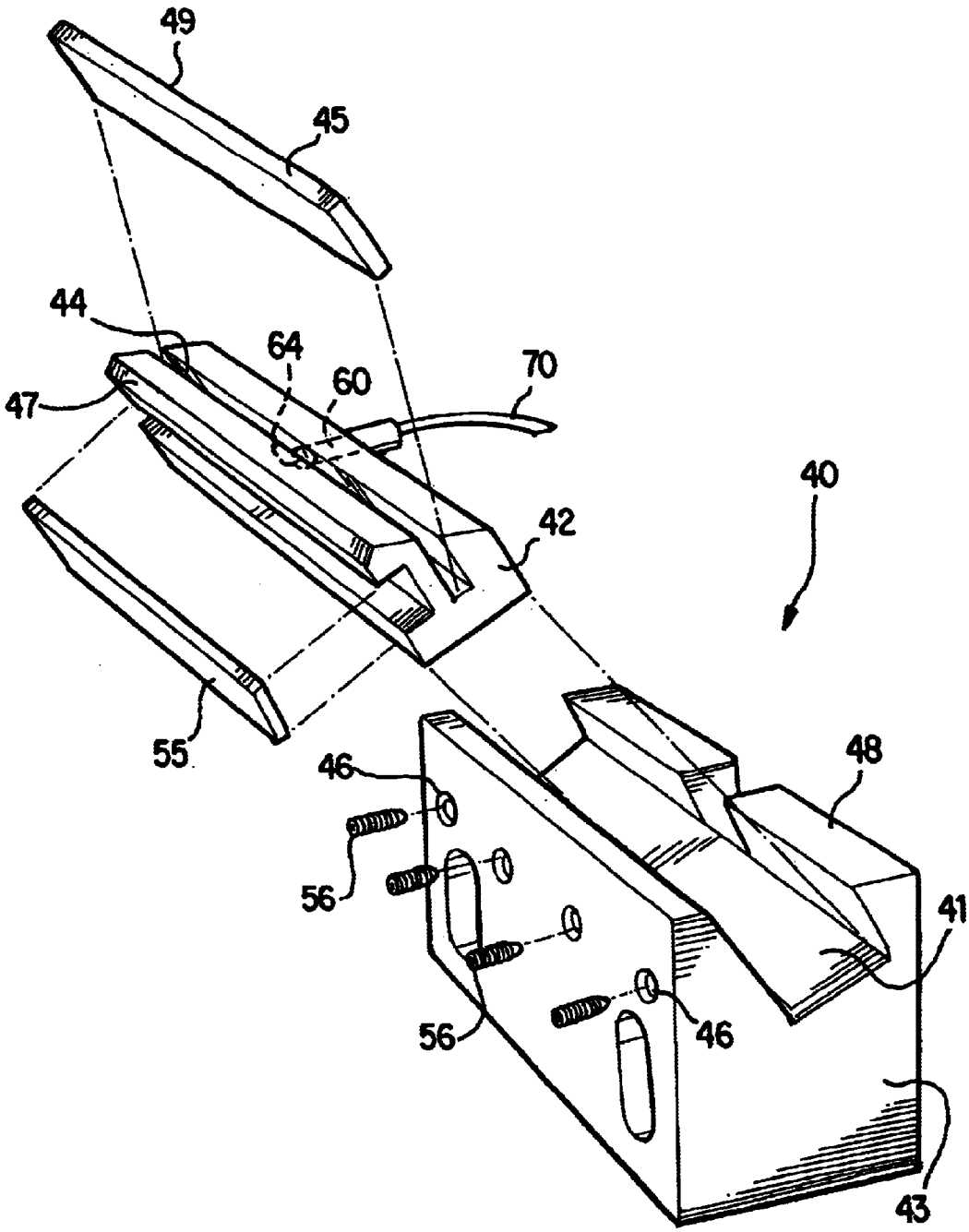
FIG. 7 is an exploded perspective view of an anvil as shown in FIG. 5 and electric current delivering members.

As shown in FIGS. 5 and 7, each anvil 40 has an anvil block 43 which includes a channel 41 with a U-shaped cross section. An anvil blade holder 42 and a respective metal anvil blade 45 are secured within the channel 41. The channel 41 is tilted within the anvil 40 so that its bottom wall extends at an angle to the upper surface 48 of the anvil 40 to maintain the proper angle of contact between the anvil blades 45 and the perforating blades 21. Each anvil block 43 is typically formed of a rigid material such a steel that will not fail during the operation of the perforator. Two spring urged bolts (not shown) extend through each anvil block 43 for securing it to the perf head 80. The anvil blocks 43 are also connected to the perf head 80 by a central threaded bolt 81 which is received in a threaded hole in the anvil 40. In addition, a pair of adjustment screws 82 are positioned on either side of this central bolt 81 for adjusting the distance the anvil 40 is from the perforating roll 20 in order to control the pressure that an anvil blade 45 makes with a respective set of perforating blades 21, as is well known. For example, if one end of the anvil blade 45 needs to make additional contact with the perforating blades 21 to achieve a complete perforation of the web 12, the adjustment bolt 82 on that side of the anvil block 43 is advanced against the bottom of the anvil block 43, in order to move the anvil blade 45 into contact with the perforating blades 21. The anvil blade holder 42 is formed of DELRIN or other well known electrically insulating materials that will not fracture during the operation of the perforator.

Figure 3:
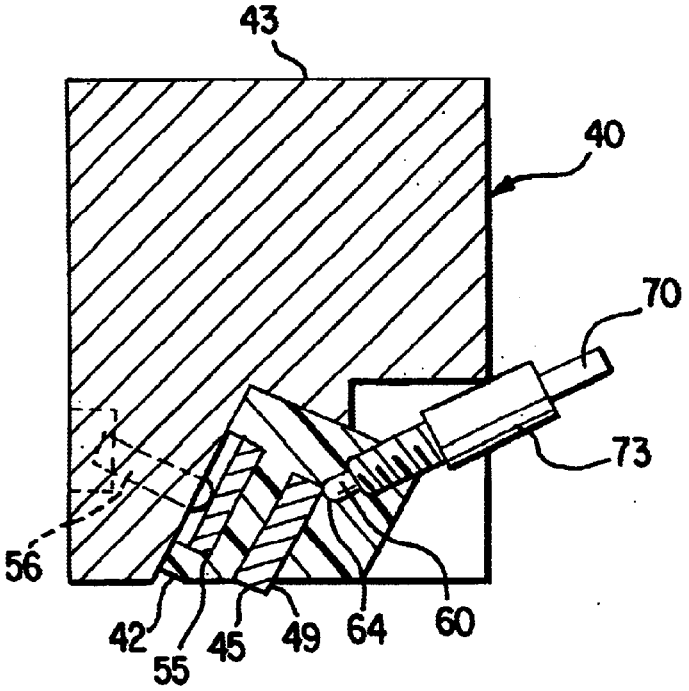
FIG. 3 is a cross section of an anvil shown in FIG. 1.

A shoe 55 and an interference screws 56 secure blade holder 42 within channel 41. As shown in FIG. 3, the blade holder 42 includes a groove 44 for receiving the metal anvil blade 45 and electrically isolating it from its respective anvil block 43 and the other metal parts of the anvil 40. The shoe 55 is positioned within channel 41 between one of its inner walls and a cantilevered portion 47 of the blade holder 42. As the interference screws 56 are advanced through a tapped hole 46 in the anvil block 43, the shoe 55 is advanced toward the anvil blade 45 and deflects the cantilevered portion 47 in the direction of the anvil blade 45 for securing the anvil blade 45 within the groove 44.

In order to accommodate the insulating blade holders 42, the anvil blocks 43 according to the present invention extend further away from the mounting surface 84 of perf head 80 than do conventional anvil blocks. As a result, the anvil blades 45 are also positioned further away from the mounting surface 84 on the perf head 80 than conventional anvil blades. To compensate for this change in distance and to allow the present invention to be used with conventional perforators, the groove 44 positions the anvil blade 45 at a different angle than conventional anvils. This results in the contact angle between the perforating blades 21 and the anvil blades 45 being the same, or substantially the same, as that accomplished by the apparatus shown in U.S. Pat. No. 2,870,840 to Kwitek. The difference between the angle at which groove 44 positions the anvil blade 45 and the conventional positioning angle will change from perforator to perforator depending on the size difference between a conventional anvil block and the anvil block according to the present invention. This angle also directs the forces applied to the anvil blade 45 by the perforating blade 21 into the anvil block 43.

As shown in FIGS. 3 and 4, the anvil blade 45 has a blade contacting face 49 extending at an angle to the upper surface of the anvil and the rotating perforating blades 21 when positioned in the blade receiving groove 44. This contacting face 49 creates a contact area which permits the contacting members 76 of the perforating blades 21 to strike the web 12 and the contacting face 49 of the anvil blade 45, and perforate the web 12, as shown in FIG. 6. The anvil blades 45 include a rigid steel bar or other such material with a thickness that will withstand the pressure applied by the perforating blades 21 without breaking.

The anvils 40, as shown best in FIG. 6, support the anvil blades 45 in a spiral arrangement along perf head 80, as shown in FIG. 1, so that as each blade 21 of the perforating roll 20 moves in a counterclockwise direction, each of the contacting members 76 in longitudinal alignment on roll 20 engages a corresponding anvil blade 45 in a successive movement during the arc of travel shown between the first anvil 40 at the right of FIG. 6 and the last anvil 40 indicated at the left-hand side of FIG. 6. The distance between the first and last anvils 40 in the direction of the spiral arrangement is less than the distance between adjacent rows of the perforating blades 21 so that the signal, discussed below, generated for a first row of anvil blades 21 does not overlap with the signal for an adjacent row of anvil blades 21. Not only is the row of blades 45, as shown in FIG. 1, at an angle, but each individual blade 45 is at an angle so that the cutting at any instant is at a single point of contact.

In the operation of the apparatus, the paper web 12 is advanced, as indicated by the arrows in FIG. 4, over the perforating roll 20. As the web 12 is carried forwardly in the direction of the arrow on roll 20, the blade 21 at one end of the roll 20 engages the anvil blade 45, and then successively the blades 21 running longitudinally of roll 20, engage the spirally-arranged individual anvil blades 45, so as to perforate the web 12 transversely, the perforations, however, being produced sequentially from one edge of the web to the other. The perforated web 12 then leaves the roll 20 and is further processed.

Figure 8:
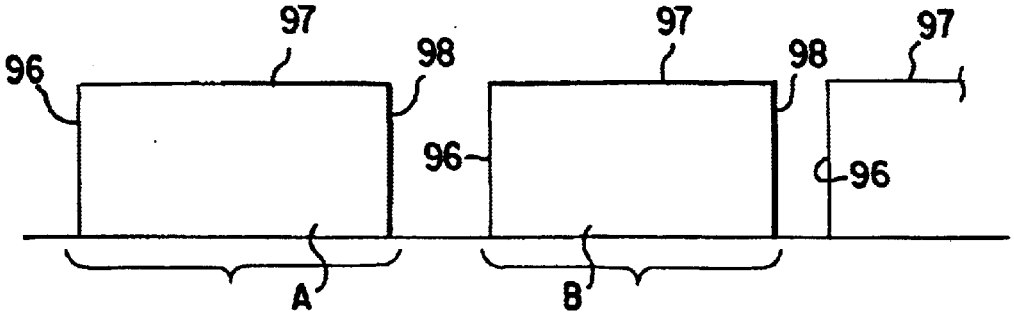
FIG. 8 illustrates a representative waveform or trace indicating that a closed circuit was formed and maintained along the lengths of monitored anvil blades A and B.

As previously discussed, the web 12 may not be fully perforated during the operation of the perforator 15 if one or more of the blades 21, 45 do not penetrate completely through the web 12 because they are broken or dull, or if one or both ends of an anvil blade 45 are not in proper position relative to the perforating roll 20. The present invention includes a system for detecting and signaling an operator when one or more of the contacting members 76 of a perforating blade 21 do not fully cut through the passing web 12. The detecting and signaling system supplies an electric current to the anvil blades 45 isolated by the insulating blade holder 42 when they are contacted by one of the grounded perforating blades 21. Therefore, as the grounded contacting members 76 of the perforating blades 21 contact their respective anvil blades 45, current flows to the contacted portion of the anvil blade 45 and a closed circuit is formed. This closed circuit can be electronically represented as a waveform and interpreted by the operator using a device such as an oscilloscope. Alternatively, the generated waveform representation can be received and compared to a reference waveform or other representation by a microprocessor. A logics program can also be used to provide a signal to the operator identifying the status of the perforation operation. If a closed circuit is created and maintained across the face of the anvil blade 45, the generated electronic representation will be "normal" and the operator will know that the web 12 is being fully perforated. The generated representation can be a waveform or trace, as shown in FIG. 8, with a first vertical line 96 indicating when the closed circuit was created, a flat horizontal line 97 indicating that the circuit was maintained and a second vertical line 98 indicating when the circuit was opened.

Figure 9:
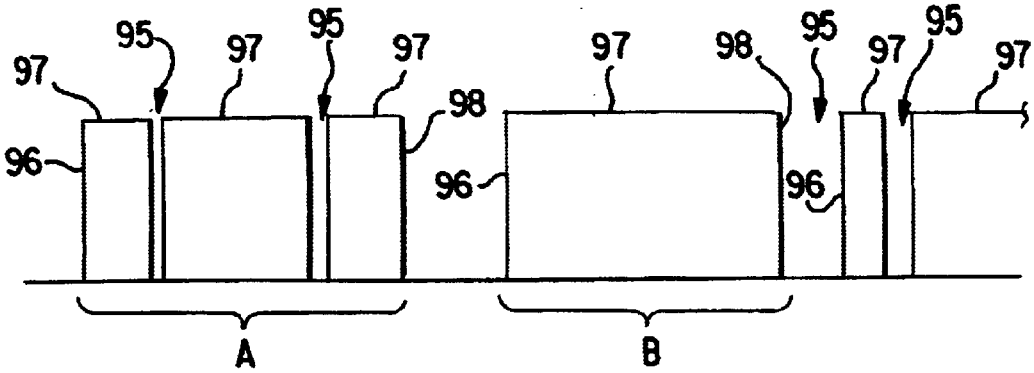
FIG. 9 illustrates a representative waveform or trace indicating that open and closed circuits were formed along the lengths of the monitored anvil blades A and B.
Figure 10:
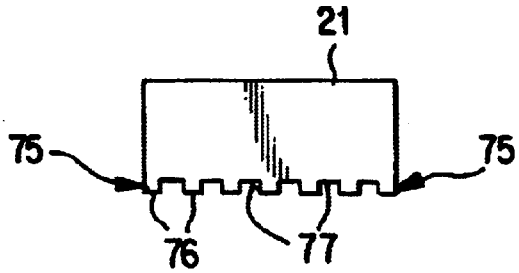
FIG. 10 illustrates a perforating blade according to the present invention.

If for some reason, such as a broken, dull or out of position blade 21, 45, a contacting member 76 does not pass through web 12 and contact the anvil blade 45, an open circuit will exist at that position along the face of the anvil blade 45. This open circuit is represented as an anomaly 95 or other type of deviation in the interpreted electronic representation. In one embodiment, when the representation of the formed circuit includes such an anomaly, the presence of the anomaly is visually evident in the generated waveform or trace displayed by an oscilloscope. Such a representation is shown in FIG. 9. As discussed above with respect to FIG. 8, the vertical lines 96–99 indicate when a closed circuit has been established and how long it is maintained along the length of the blade 45. The presence of the anomaly can also be communicated to the operator by an audio or visual alarm, such as sirens or lights, produced by the logic carrying processor that interprets the generated circuit representation. The operator is then on notice that the perforator must be stopped and the blades 21, 45 inspected.

In order to provide the electric current to the anvil blades 45, the present invention includes an electric generator which produces a low amperage current at low voltage and low impedance. Electrically conductive probes 60 (also referred to as conductors) each contact a respective one of the anvil blades 45 and electrically couple the blades 45 to an electric current carrying cable 70 as shown in FIGS. 3 and 4. Each electrically conductive probe 60 is threaded into a tapped hole in one of the insulating blade holders 42. A female end 65 of the probe 60 receives a male end 71 of the current carrying cable 70 for delivering the current carried by the cable 70 to the male end 64 of the probe 60 which contacts the anvil blade 45. The male end 64 can be spring loaded so that it can move within the blade holder 42 in order to adjust to different sized cables and different sized anvil blades. When assembled, the current carrying male end 71 is electrically connected to the male end 64 of the probe 60 so that current will flow from the generator to the electrically isolated anvil blade 45. The cable 70 includes a coupling cover 73 which mates with the outer surface of female end 65 to hold the cable 70 on the probe 60. In a preferred embodiment, cables 70 are shielded similar to sparkplug wires. The shielded cables 70 prevent interference with the circuit and are easy to connect to the probes 60 on the anvil blade.

During operation of the perforating apparatus 10, a current having low amperage in the range of 100 milliamps is applied to the anvil blades 45 via cable 70 and probe 60. The perforating roll 20 is rotated by a driving mechanism and perforating blades 21 move relative to the anvils 40. Each perforating blade 21 contacts the web 12 extending between it and a respective one of the anvil blades 45. However, before a perforating blade 21 contacts a cooperating anvil blade 45, an open circuit exists across the anvil blade 45. This open circuit is represented to the detecting system. As discussed above, the insulating blade holder 42 prevents the current applied to the anvil blade 45 from traveling to the anvil 40 or machine frame and thereby completing a circuit separate from the perforating blades 21. As a contacting member 76 of the grounded perforating blade 21 makes contact with the anvil blade 45, it acts like a switch and creates a closed (hot) circuit with the anvil blade 45 at each point of contact. This closed circuit will remain along the anvil blade 45 as long as one of the contacting members 76 of blade 21 is always in contact with blade 45. When contact is interrupted as a result of a broken or dull perforating blade, or an out of position anvil blade, the circuit will open.

The results of the contact between the perforating blades 21 and anvil blades 45 and the resulting circuit can be represented and monitored in many ways. One such way is to generate a signal that can be represented as a waveform, as discussed above and shown in FIGS. 8 and 9. In one embodiment, the generated signal is supplied to an oscilloscope which is monitored by an operator. As long as the generated trace is free of anomalies 95, as shown in FIG. 8, the operator will permit the perforator to continue to operate normally. When a waveform having an anomaly, such as that shown in FIG. 9, is produced, the operator will stop the machine and change the broken blade 21, 45 or adjust the position of the anvil blade 45 relative to the perforating roll 20. These anomalies are clearly visible on the oscilloscope. As a result, an experienced operator may be able to locate the broken portion of blade by merely looking at the location of the anomaly along the waveform.

In another embodiment, the generated signal can be sent to a computer 90 and interpreted by a microprocessor 91. In this embodiment, the microprocessor 91 compares the generated signal or waveform to a "normal", reference waveform. When the generated waveform is the same as the reference waveform, the machine operates as normal. When the presence of an anomaly 95 is detected in the generated waveform, a logic circuit activates an alarm 92 which generates a signal alerting the operator to the existence of the anomaly and the fact that the web 12 is not being fully perforated. This signal can take the form of an audible message such as a statement or a siren. Alternatively, the signal could activate a flashing light or other visual indicators. It is contemplated that the machine can be automatically stopped when an anomaly is detected so that the minimum possible amount of unperforated product is produced.

If the microprocessor 91 is used to detect the anomaly, it can also be used to indicate which contacting member(s) 76 is (are) not making contact with the anvil blades 45. In this embodiment, a shaft encoder would be used in combination with the microprocessor 91 so that the microprocessor 91 will indicate the existence of the anomaly and its position along the length of the perforating shaft 20 and around its circumference. The shaft encoder is mounted on the machine frame and set so that the beginning of a row of perforating blades is at 0 degree. The contact with an anvil blade 45 of each successive perforating blade 21 will be interpreted as a different position along the 360 degree circumference of the shaft 20 as a result of the helical positioning of the anvil blades 45. Therefore, as the shaft 20 rotates and the perforating blades 21 pass the helically positioned anvil blades 45, the contact point being analyzed will move along the circumference of the perforating shaft 20. For example, if the last anvil blade 45 is 30 degrees offset along the circumference of the perforating shaft 20 from the first anvil blade 45, an anomaly detected at 30 degrees will be in the last blade 21 of the first row. If there are four rows of perforating blades, then an anomaly detected at 105 degrees will be in the center perforating blade 21 in the second row.

Numerous characteristics, advantages and embodiments of the invention have been described in detail in the foregoing description with reference to the accompanying drawings. However, the disclosure is illustrative only and the invention is not limited to the illustrated embodiments. Various changes and modifications may be effected therein by one skilled in the art without departing from the scope or spirit of the invention. For example, the current could be provided to the rotating perforating blades 21 by positioning electrical brushes in contact with the shaft 20 and the anvil blades 45 could be grounded. Also, the web can be fed into the perforator and across the face of the anvil blades as flat continuously moving substrate or it can be fed over the perforating roll so that it advances as the perforating roll rotates. Moreover, while disclosed to be used with systems that perforate a web in a direction normal to its length, the detecting system can be used with systems that perforate a web in directions parallel to its length.

We claim:

1. An apparatus for perforating a web and detecting when the web is not being fully perforated, said apparatus comprising:

at least one anvil including a blade holder and an anvil blade positioned within said blade holder, said blade holder being formed of an insulating material for electrically isolating said anvil blade from a ground when said anvil blade is free of contact with a grounded perforating blade;

a conductor coupled to said anvil blade for supplying an electric current from a current source to said anvil blade;

at least one grounded perforating blade for moving relative to said at least one anvil blade and cooperating with said at least one anvil blade to perforate the web at predetermined points, said at least one perforating blade moving relative to said anvil blade for contacting said anvil blade after perforating the web so that a closed circuit is formed along the at least one anvil blade where said anvil and perforating blades are in contact; and means for detecting if a closed circuit has been formed and maintained along a length of said at least one anvil blade when said perforating blade moves across said anvil blade, said means including a processor for determining when said expected closed circuit has not been formed, and an indicator for notifying when said expected closed circuit has not been formed.

2. The apparatus for perforating a web according to claim 1 wherein said at least one perforating blade includes a plurality of perforating blades, and wherein said at least one anvil blade includes a plurality of anvil blades.

3. The apparatus for perforating a web according to claim 2 wherein each of said perforating blades includes a plurality of perforating members.

4. The apparatus for perforating a web according to claim 2 wherein said perforating blades are secured to a perforating roll which rotates relative to said anvil blades.

5. The apparatus for perforating a web according to claim 1 wherein said anvil includes a blade block, and wherein said insulating blade holder spaces and electrically isolates said anvil blade from said blade block.

6. The apparatus for perforating a web according to claim 1 wherein said conductor includes a spring biased probe for contacting said at least one anvil blade.

7. The apparatus for perforating a web according to claim 1 further including a shielded cable having a first end for connecting to said conductor and a second end for being electrically coupled to the current source.

8. The apparatus for perforating a web according to claim 1 wherein said means for detecting includes a microprocessor which receives a generated representation of the closed circuit created between said at least one perforating blade and said at least one anvil blade, and wherein said microprocessor interprets the representation for determining if the at least one perforating blade did not make complete contact with the at least one anvil blade.

9. The apparatus for perforating a web according to claim 8 wherein said microprocessor compares said generated representation to a reference representation, and further includes a signaling device for notifying an operator when the generated representation differs from said reference representation.

10. The apparatus for perforating a web according to claim 1 wherein said means for detecting includes means for indicating to an operator when a complete circuit has not been formed across said at least one anvil blade.

11. An apparatus for forming and detecting perforation holes in a web, said apparatus comprising:

an anvil blade and a cutting blade cooperating with said anvil blade to cut through a web positioned between said blades, one of said blades being electrically grounded and the other of said blades being electrically isolated from a ground when free of contact with the electrically grounded blade;

a conductor coupled to said other of said blades for delivering an electric current from an electric current source to said other of said blades while said blades are in contact with each other at a perforating position, whereby when said blades contact each other a closed circuit is formed and whereby when said blades are in said perforating position and free of contact with each other a circuit is not formed; and a closed circuit detecting system electrically coupled to said conductor and said other of said blades, said system including a processor for determining when an expected closed circuit has not been formed along a portion of said other of said blades, and an indicator for notifying when said expected closed circuit has not been formed.

12. The apparatus according to claim 11 wherein said one of said blades is said cutting blade and said other of said blades is said anvil blade; and wherein said cutting blade includes a plurality of cutting members.

13. The apparatus according to claim 11 further comprising an anvil having an anvil blade holder into which said anvil blade is secured, said anvil blade holder including an electric insulating material for electrically isolating said anvil blade from said anvil.

14. The apparatus according to claim 13 wherein said anvil blade is formed of an electrically conductive material; and wherein said conductor includes an electrically conductive member in contact with said anvil blade for providing current from the current source to said anvil blade.

15. The apparatus according to claim 14 further including a shielded cable having a first end for contacting said electrically conductive member and a second end for being electrically coupled to the current source.

16. The apparatus according to claim 13 wherein said anvil blade holder and said anvil blade are removably secured within said anvil by a securing member.

17. The apparatus according to claim 11 wherein said apparatus further comprises a plurality of anvil blades and a plurality of cutting blades.

18. The apparatus according to claim 17 further comprising a plurality of conductors each being electrically coupled to a respective one of said anvil blades for delivering an electric current to said respective one of said anvil blades.

19. The apparatus according to claim 11 wherein said closed circuit detecting system includes an oscilloscope which shows a representative waveform which indicates to an operator where contact has been made between said blades.

20. The apparatus according to claim 11 wherein said closed circuit detecting system includes a microprocessor which compares a generated circuit formation trace to a reference trace and signals an operator when the generated trace differs from said reference trace.

21. The apparatus according to claim 11 wherein said cutting blade is secured to a shaft which rotates the cutting blade relative to said anvil blade.

22. An apparatus for perforating a web and detecting when the web is not being fully perforated, said apparatus comprising:

at least one anvil including a blade holder and an anvil blade positioned within said blade holder, said blade holder being formed of an insulating material for electrically isolating said anvil blade from a ground when said anvil blade is free of contact with a grounded perforating blade;

a conductor coupled to said anvil blade for supplying an electric current from a current source to said anvil blade;

at least one grounded perforating blade for moving relative to said at least one anvil blade and cooperating with said at least one anvil blade to perforate the web at predetermined points, said at least one perforating blade moving relative to said anvil blade for contacting said anvil blade after perforating the web so that a closed circuit is formed along the at least one anvil blade where said anvil and perforating blades are in contact; and a closed circuit detecting system electrically coupled to said conductor and said anvil blade, said system including a processor for determining when an expected closed circuit has not been formed along a portion of said anvil blade, and an indicator for notifying when said expected closed circuit has not been formed.

* * * * *